US011085262B2

(12) United States Patent
Keller

(10) Patent No.: US 11,085,262 B2
(45) Date of Patent: Aug. 10, 2021

(54) METHOD OF INSTALLATION OF A FLEXIBLE BOREHOLE LINER WITHOUT EVERSION

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 0 days.

(21) Appl. No.: 16/746,322

(22) Filed: Jan. 17, 2020

(65) Prior Publication Data

US 2020/0232292 A1 Jul. 23, 2020

Related U.S. Application Data

(60) Provisional application No. 62/793,774, filed on Jan. 17, 2019.

(51) Int. Cl.
*E21B 23/01* (2006.01)
*E21B 43/10* (2006.01)

(52) U.S. Cl.
CPC ..... *E21B 23/01* (2013.01); *E21B 43/108* (2013.01)

(58) Field of Classification Search
CPC ..... E21B 23/01; E21B 43/108; E21B 17/00
See application file for complete search history.

(56) References Cited

U.S. PATENT DOCUMENTS 4,778,553 A 10/1988 Wood
5,176,207 A 1/1993 Keller
5,246,862 A 9/1993 Grey et al.
5,377,754 A 1/1995 Keller
5,725,055 A 3/1998 Schirmer
5,803,666 A 9/1998 Keller
5,804,743 A 9/1998 Vroblesky et al.
5,853,049 A 12/1998 Keller
6,026,900 A 2/2000 Keller
6,109,828 A 8/2000 Keller
6,244,846 B1 6/2001 Keller
6,283,209 B1 9/2001 Keller
6,910,374 B2 6/2005 Keller
7,281,422 B2 10/2007 Keller
7,753,120 B2 7/2010 Keller
7,841,405 B2 11/2010 Keller
7,896,578 B2 3/2011 Keller
8,069,715 B2 12/2011 Keller
(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.
(Continued)

*Primary Examiner* — Dany E Akakpo
(74) *Attorney, Agent, or Firm* — Rod D. Baker

(57) ABSTRACT

A method and apparatus for installing a flexible liner directly into a pipe or borehole without everting the liner. The liner is lowered directly, without eversion, into either a cased borehole with slotted screens, or in an uncased borehole, without the hazard of abrasion of the liner. A removable protective sheath temporarily disposed around the liner avoids damaging penetration of the liner during installation. By the invention, it is possible to include tubing and other measuring and sampling devices attached to the liner that are too stiff to be included on an everting liner. Means and methods for releasably attaching the sheath to the liner, and for anchoring the liner in a borehole, are provided.

20 Claims, 10 Drawing Sheets

(56) References Cited

U.S. PATENT DOCUMENTS

| | | | | |
|---|---|---|---|---|
| 8,176,977 | B2 | 5/2012 | Keller | |
| 8,424,377 | B2 | 4/2013 | Keller | |
| 9,008,971 | B2 | 4/2015 | Keller | |
| 9,534,477 | B2 | 1/2017 | Keller | |
| 9,797,227 | B2 | 10/2017 | Keller | |
| 10,030,486 | B1 | 7/2018 | Keller | |
| 10,060,252 | B1 | 8/2018 | Keller | |
| 10,139,262 | B2 | 11/2018 | Keller | |
| 10,337,314 | B2 | 7/2019 | Keller | |
| 2012/0173148 | A1 | 7/2012 | Keller | |
| 2018/0274312 | A1* | 9/2018 | Zhou | E21B 43/08 |
| 2018/0371882 | A1* | 12/2018 | Delange | E21B 43/108 |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner (Prior Art)

FIG. 3
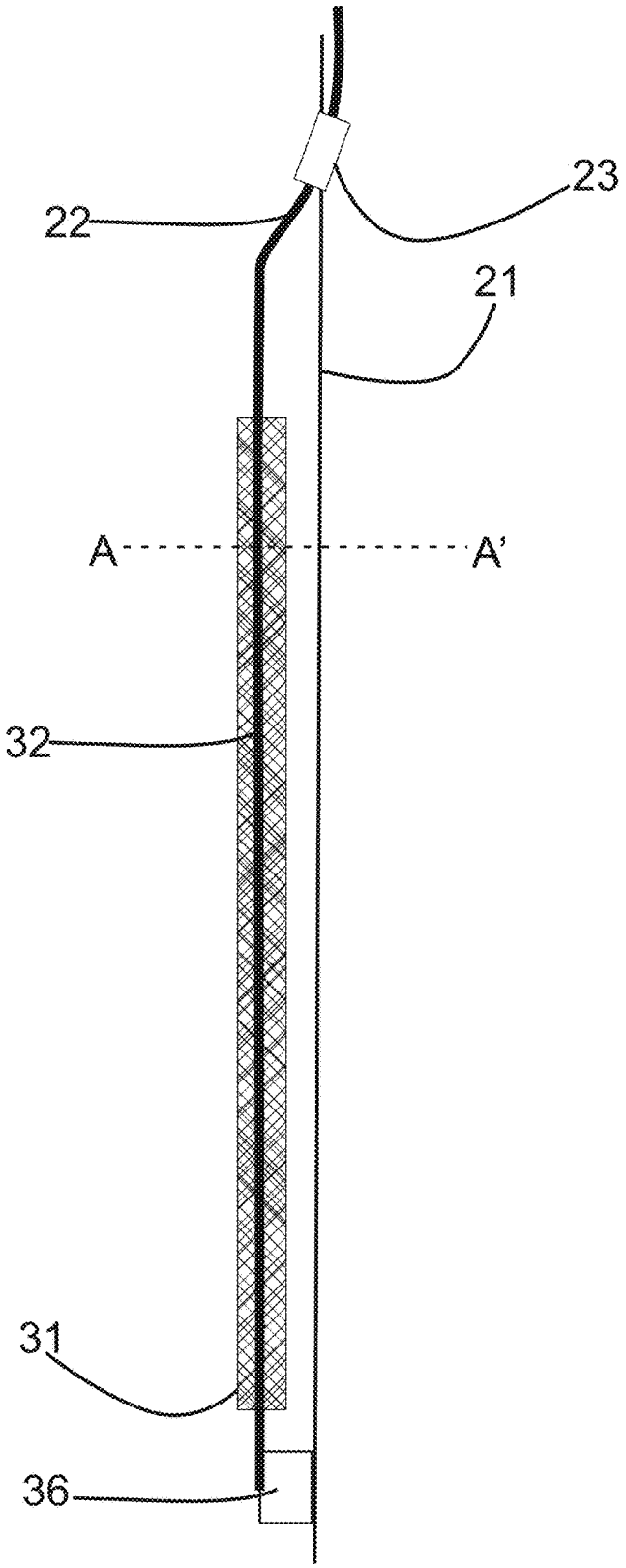
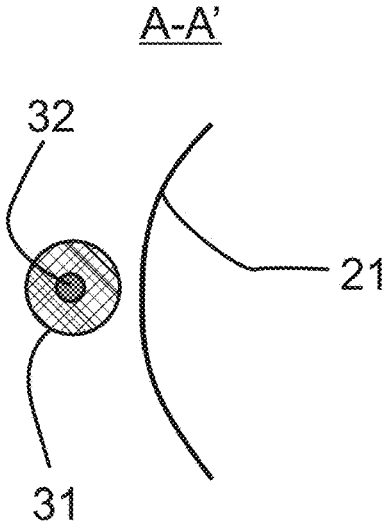
FIG. 3A

METHOD OF INSTALLATION OF A FLEXIBLE BOREHOLE LINER WITHOUT EVERSION

CROSS-REFERENCE TO RELATED APPLICATIONS

This application claims priority to and the benefit of the filing of U.S. Provisional Patent Application Ser. No. 62/793,774 entitled "Method for Installing a Flexible Borehole Liner Without Eversion," filed 17 Jan. 2019, the entire disclosure of which is incorporated herein by reference.

BACKGROUND OF THE INVENTION

Field of the Invention

This invention relates to the installation of flexible borehole liners into boreholes in geologic formations with either shallow or deep water tables, and more particularly to a method for placing a flexible liner into a borehole without everting the liner down the borehole.

Background Art

A "borehole" is a hole, e.g., a drilled shaft, into the Earth's subsurface. The hydraulic conductivity profiling techniques described in, for example, my U.S. Pat. Nos. 6,910,374 and 7,281,422 have been used in over 400 boreholes since 2007. These patents, whose complete teachings are hereby incorporated by reference, describe the hydraulic transmissivity profiling technique which carefully measures the eversion of a flexible borehole liner into an open stable borehole. Other installations of flexible liners into boreholes by the eversion of the liners are used for a variety of known down-hole techniques. Installation of borehole liners by eversion, and some utilities of liners so installed, are disclosed in, for example, my previous U.S. Pat. Nos. 5,176,207, 5,803,666, 6,244,846 and 9,008,971, which are incorporated herein by reference. In the eversion of a liner, one end of the liner is secured around the top of the borehole (e.g., on the casing), while the other closed end is forced down the borehole by fluid pressure; as the closed end of the liner progresses down the borehole the liner turns inside-out. The "inside" of the liner everts to become the outside surface of the liner, which surface is pressed against the borehole wall by the liner's interior fluid pressure. Everted liners are usually installed into the open boreholes using a water level inside the liner which is significantly higher than the water table in the formation penetrated by the borehole. The excess head drives the liner down the borehole, displacing any ambient borehole water.

However, when that required excess head is not available within the borehole, a scaffold plus an extension of the surface casing are often used to achieve the higher water level within the liner. In some situations of very shallow water tables, or in situations where the head within the borehole would rise above the ground surface if the surface casing were extended above the surface (an artesian condition), the required scaffold would be so high as to be dangerous. And high scaffolding may expose the installation personnel to freezing winter winds.

A larger constraint on the methods of everting a flexible liner into a borehole is that the tubing (e.g., sample tubing) accompanying the liner, and required for extraction or injection of fluids into the geologic formation, is too stiff to be everted with the liner. This ordinarily is the case for tubing of ⅜" outside diameter or larger. In this disclosure and in the claims, "large diameter," in reference to tubing, means 0.375 or more inches outside diameter. Another limitation is that the spacer typically used on the exterior of the liner to define the extraction or injection interval is too stiff to evert along with the liner, especially into relatively small-diameter boreholes.

The limitations on the eversion method of flexible liner installation are even greater for large-diameter holes. It is impractical to evert tubing with the liner into boreholes of less than 3 inches diameter. A technique described in my U.S. Pat. No. 6,298,920, granted Oct. 9, 2001, uses a rigid pipe to allow the non-eversion installation of a flexible liner by lowering the liner through the interior of the pipe. But such pipe is bulky and difficult to ship and assemble in the field. Installations by the method of U.S. Pat. No. 6,298,920 also present certain other deficiencies, such as not including common water sampling devices and systems.

Another known method used to isolate an interval in a borehole for fluid extraction or injection is called a straddle packer, which uses two bladders on a central pipe. Straddle packer devices are not well-suited for isolation of multiple intervals in a borehole for simultaneous extraction of fluid samples. The straddle packer method isolates the straddled interval, but with the remainder of the borehole open or unsealed. Hence, there is a risk of bypass of the bladders between the open holes above and below the straddled interval.

With the foregoing background, the presently disclosed invention was developed. The invention described hereafter allows the installation of a flexible liner without using the previously known eversion process. The method of the present invention therefore does not require the excess fluid pressure head to evert and drive the liner, and does not require scaffolding for installation in shallow water tables or under artesian conditions. A particular advantage of the disclosed invention is that the installation does not require the trained installers often needed for the everting liner installation procedure.

SUMMARY OF THE INVENTION

There is disclosed herein a method and apparatus to allow a flexible liner to be installed into a pipe or borehole for a variety of applications such as sealing the borehole, a water sampling device, mapping contaminant distributions, injecting remediation fluids into contaminated aquifers, and for the purpose of measuring the water table at numerous elevations in a borehole. The inventive installation by lowering the liner into either a cased borehole with slotted screens, or in an uncased borehole, is possible without the hazard of abrasion of the liner. Liner abrasion and associated leakage are normally a concern when lowering a liner into the uncased borehole. The present apparatus and method use a removable protective sheath to avoid the typical abrasion penetration of a flexible liner lowered into an open borehole. By the invention, it is possible to include tubing and other devices attached to the liner that are too stiff to be included in an everting liner. This invention has the additional advantage of installation by personnel less skilled in the art of installation of everting liners, especially in boreholes of low transmissivity. A further advantage of the invention is that the fabrication procedure is possible with tubing too stiff to be included in the normal everting liner construction procedure. That same fabrication advantage allows the construction of very slender flexible liners, as small as two inches in diameter, which can then be installed into the casing (when eversion of such slender liners with tubing is not possible). Another aspect of the invention is that several sampling intervals can be separated by a hydrologic seal between the discrete sampling intervals, even in a continuously screened casing. The sampling intervals are defined by an especially compact design to allow the passage through the hole or casing.

BRIEF DESCRIPTION OF THE DRAWINGS

The attached drawings, which form part of this disclosure, are as follows:

FIG. 3 is a side view of a slender and compact spacer geometry useful with the basic liner to be installed according to the present invention;

FIG. 3A is a horizontal partial section view, taken along section A-A' of FIG. 3, of the spacer and liner configuration of FIG. 3;

The drawing figures are not necessarily to scale, either within a single view or between views. Like numeral labels typically identify like or similar elements throughout the several views.

DESCRIPTION OF THE INVENTION, (INCLUDING THE BEST MODE FOR PRACTICING THE INVENTION)

Figure 1:
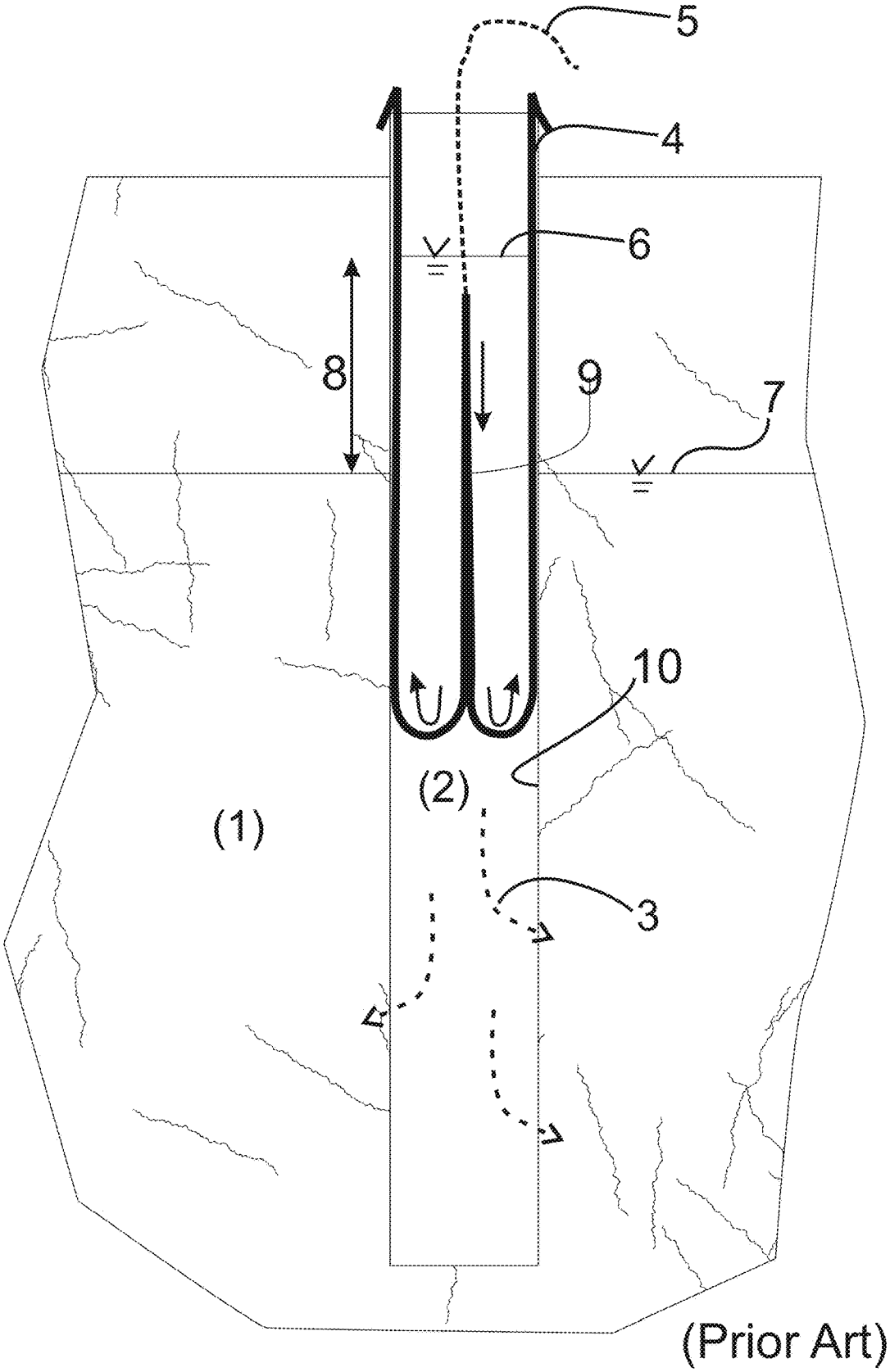
FIG. 1 is a side sectional view of a typical everting liner installation known in the art.

Flexible liner installation typically is accomplished by everting the liner into position in the borehole. Such installation method is illustrated in FIG. 1. The eversion process requires a water level 6 in the liner 4 a distance 8 above the water level 7 in the surrounding geologic formation 1. The pressure of the higher water level 6 causes the liner 4 to evert. The inverted liner 9 passes down through the interior of the everted liner 4, which lies against the borehole wall 10. This procedure avoids abrasion of the liner 9 by and against the formation 1, which can otherwise cause perforations of the liner 4. Inadvertent and undesirable perforation(s) can lead to leakage, which prevents the seal of the liner 4 against the borehole wall 10.

A natural consequence of the eversion procedure is that any water standing in the borehole 2 is driven into the surrounding formation 1. If the formation 1 is not permeable, the flow 3 from inside the borehole into the formation is not possible; water in the borehole 2 beneath the everting end of the liner prevents further eversion, and the liner eversion may cease before reaching the bottom of the borehole 2. The liner 4 of FIG. 1 may be only a sealing liner for the borehole or, as is often the case, the liner 4 has attachments of tubing, ports and spacers which are useful for extraction of ground water samples. In that case, the inability to reach the bottom of the borehole 2 requires that the water be pumped from beneath the liner 4 using a tube previously deployed in the borehole 2—which must then be removed to allow the liner to seal the borehole. That procedure is time consuming and usually done by trained individuals.

There is a need, therefore, for a system and method for installing flexible liners into boreholes without using eversion techniques, but rather by lowering the liner down the borehole with the outside surface of the liner—that surface which is to come into contact with the borehole casing or borehole wall—always facing out toward the borehole wall while the liner descends. A problem with liner installation without eversion-type placement is the need to protect the liner during its descent down the hole. The present system and method allow a liner to be lowered down a borehole while protecting it, as with a protective sheath. There also are disclosed means and method for preventing relative movement between a liner and its protective sheath while the liner/sheath combination is being lowered into the borehole according to the invention. Also disclosed are means and method for anchoring the liner in the borehole to prevent its being dragged upward after it is properly placed, and while the sheath is raised and withdrawn from the borehole. After the liner has completed service in the borehole, it may be withdrawn by inversion (pulling the liner's bottom end up first, to turn the liner outside-in), or by deflating and collapsing the liner and pulling it up directly without inversion.

Figure 2:
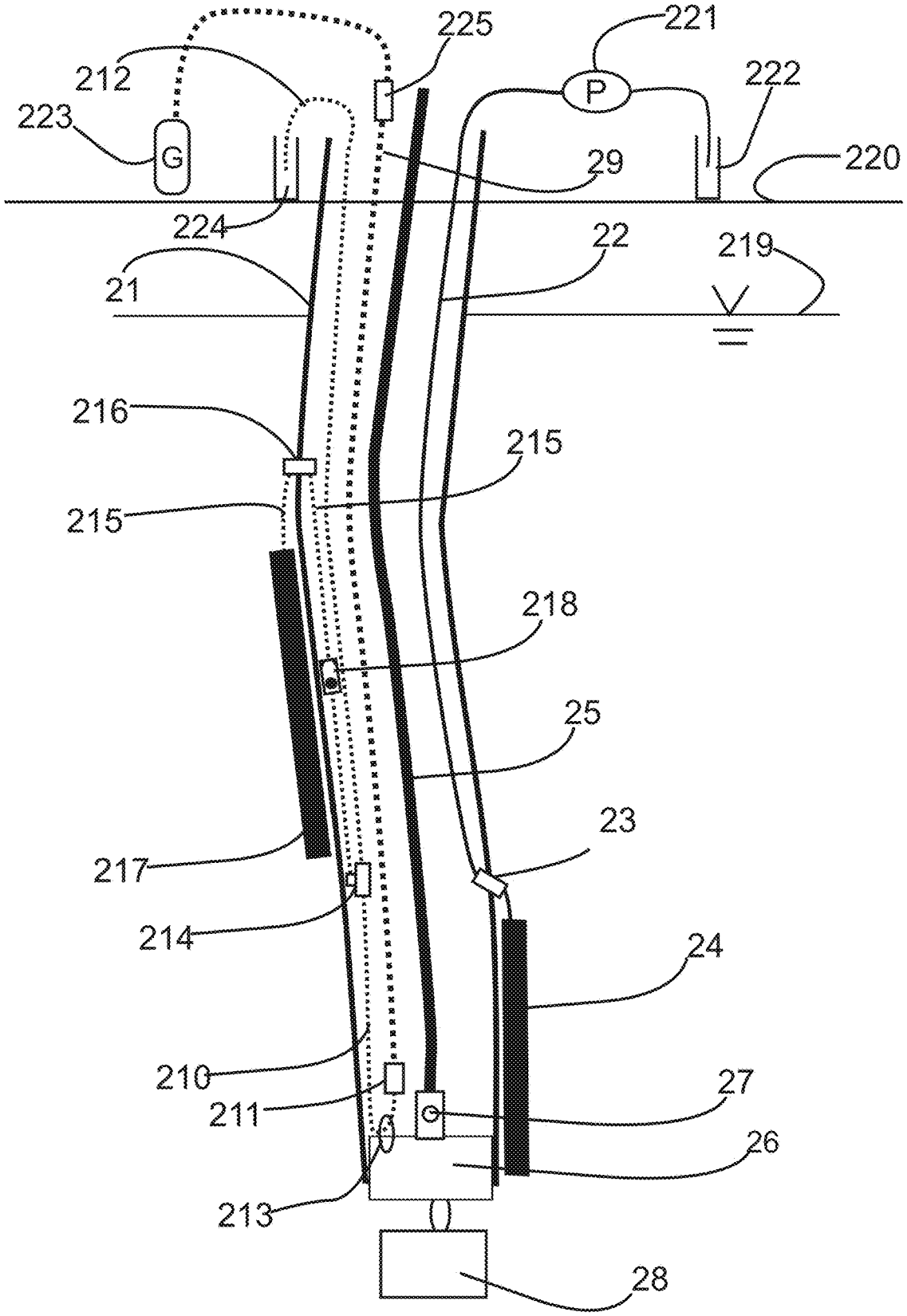
FIG. 2 is side sectional view of a basic liner, with a weighted lower end but without a protective sheath, to be lowered into a cased borehole according to the present invention.

FIG. 2 shows a liner system which is not everted into the borehole. Rather, the liner 21 is simply lowered into the borehole, and is carried or pulled by a weight 28 attached to the bottom of the liner. The figure illustrates an embodiment of a liner system as emplaced in the borehole (e.g., borehole 10 in FIG. 1) in the geologic formation 1. For the sake of illustrative clarity, the borehole and borehole wall are not depicted in FIG. 2, but reference may be had to FIG. 1 in these regards. The present method and system have numerous advantages over the everting liner 9 methodology known in the art. The lowering into place of the liner system of FIG. 2 is described hereafter. Elements of the liner system of FIG. 2 are now described. The impermeable liner 21 has a diameter as large, or slightly larger, than the open hole (borehole 2 of FIG. 1). A slender tube 22 within the interior of the liner 21 extends through a sealed port 23 through the liner 21 as seen for example in FIG. 2. The slender tube 22 extends to and through a cylindrical spacer 24 exterior to the liner 21. A central tube 25 extends to an end seal 26 at the bottom end of the liner 21. The tube 25 has a passage or port 27 to the interior of the liner 21, permitting fluid to flow between the inside of the central tube 25 and the interior of the liner. A weight 28 is connected to the seal 26, e.g. with a pivotal link 33, beneath the end seal 26. Adding water from the surface through the central tube 25 to the liner interior dilates the liner 21 against the borehole wall to seal the borehole. A water sample can be drawn upward through the slender tube 22 by a peristaltic pump 221 connected to the slender tube on the surface 220. Dropping the pressure in the slender tube 22 draws water from the formation 1, through the spacer 24 and into the slender tube, and then to the surface 220. Sample water pumped from the outlet of the peristaltic pump 221 can be collected at container 222 for evaluation.

Alternative embodiments of the system may feature, in lieu of or in addition to spacer(s) 24, other means, on the liner and in communication with tubes, for evaluating conditions in the borehole. Such other means for evaluating include a chemically absorptive or reactive element on the outside of the liner 21, such as described in my U.S. Pat. Nos. 7,896,578, and 10,060,252, or fiber optic cables and/or other sensors, including electronic sensors, known in the art for detecting, measuring, or monitoring downhole conditions.

In an alternative embodiment also depicted by reference to FIG. 2, a large diameter tube 29 is connected to a second slender tube 210 by means of a fitting 211 near the bottom of the liner 21. Beyond its connection 211 with the large diameter tube 29, the second slender tube 210 turns through 180 degrees and then extends upwards to the top of the liner at point 212 above the surface 220. At the 180-degree turn, the bent second slender tube 210 is preferably fitted with a thimble to prevent kinking of the second slender tube 210. The bent second slender tube 210 is connected to the liner end seal 26 at connection 213. An additional optional tube assembly includes a tee-and-elbow fitting 214 which connects the second slender tube 210 to an auxiliary tube 215. Auxiliary tube 215 passes through a feed-through 216 disposed in the liner 21, then to a cylindrical spacer 217 of the same or similar construction as the first spacer 24. The auxiliary tube 215 is provided with a check valve 218 therein, which is normally open to flow. The check valve 218 closes only to prevent flow when the large diameter tube 29 is pressurized.

When the liner 21 is submerged below the water table 219 in the borehole, the tubes 29, 210 fill with water flowing from the spacer 217, through the auxiliary tube 215, and through the check valve 218, thus into the tubes 29 and 210 to the level of the water table 219 in the formation 1. An electric water level meter (not shown) disposed through an access fitting 225 can be used to measure the elevation of the water table 219 as manifest inside the large diameter tube 29. In the water-filled condition, when the large diameter tube 29 is pressurized (e.g., with/from a typical regulated gas bottle system 223 at the surface 220), the water flows upward in the auxiliary tube 215, closing the check valve 218 and forcing the subsequent flow in the auxiliary tube into the second slender tube 210 and therein to the surface at point 212 for collection at container 224. The net effect of the gas pressure application, from pressure source 223 into large diameter tube 29, is to drive the water from the geologic formation 1 up into the collector container 224. Reduction to atmospheric pressure of the gas pressure applied to large diameter tube 29 allows the tubing system 29, 210 to refill with water from the spacer 217 (which water originates in the formation).

Attention is invited to FIG. 3, illustrating details of the spacer 24 configuration (essentially the same for the spacer 217, both seen in FIG. 2), which allows a filtered water sample to be drawn from the formation 1 outside of the flexible liner 21. The first slender tube 22 extends through the liner 21 via the sealed port 23. The tube 22 also extends through the center of a filter layer 31 surrounding a perforated segment 32 of the tube 22. The tube segment 32 is perforated in the interval of the slender tube 22 in which the slender tube is disposed (e.g., concentrically) inside the filter layer 31. The bottom end of the tube 34 is sealed and attached to the exterior of the liner 21 at attachment point 36. The FIG. 3A shows the cross-section A-A' depicting the central perforated tube segment 32, and the surrounding filter layer 31 which prevents sediment from entering into the slender tube 22 with water drawn from the formation 1 and through the filter layer 31. As noted, the slender tube is perforated only along that segment 32 within the interior of the filter layer 31.

Figure 4:
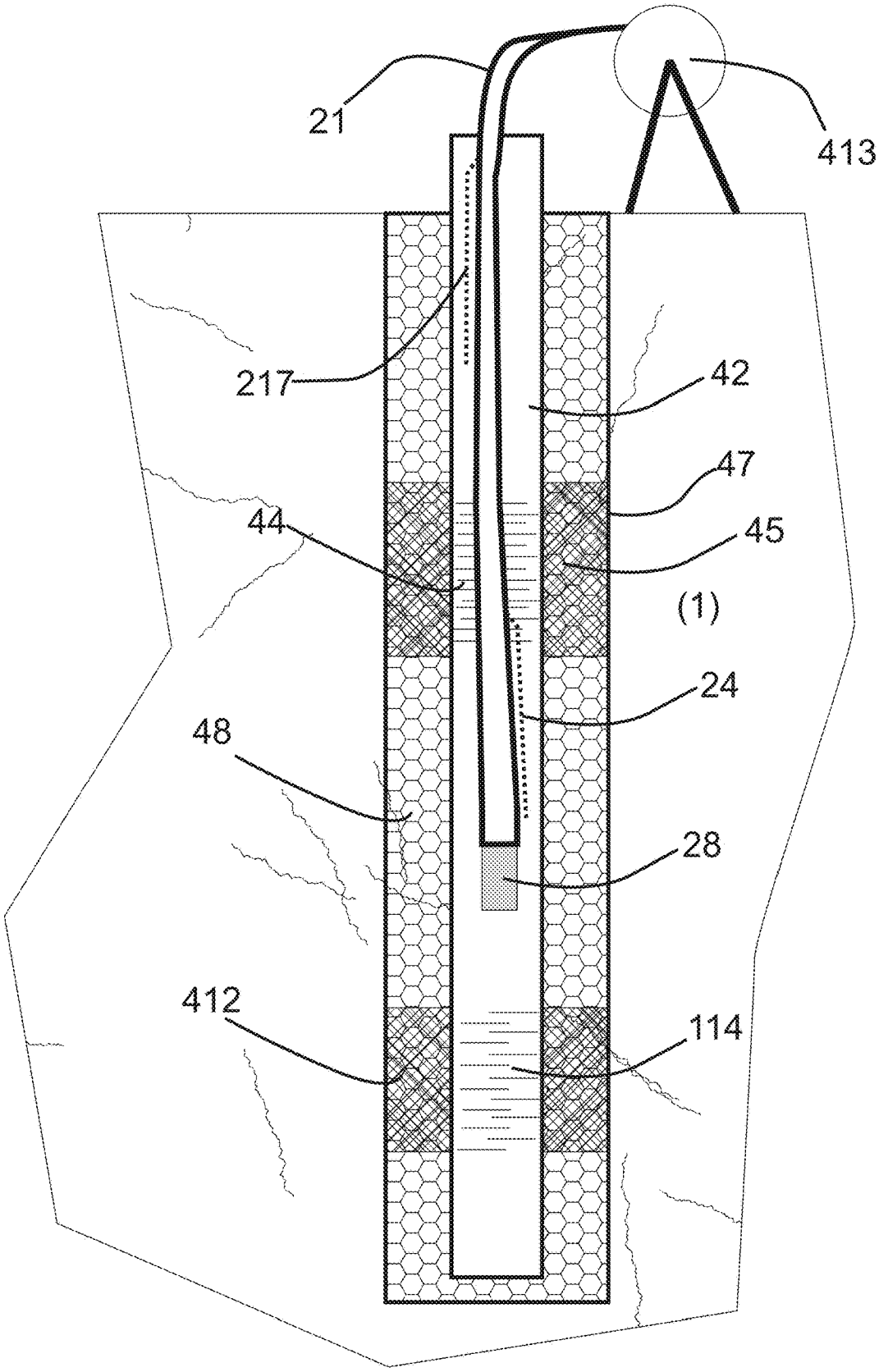
FIG. 4 is a side sectional view of a liner being lowered into a cased borehole with a suitably smooth casing, and with relatively stiff tubing attachments, somewhat rigid spacers, and special port designs, all according to the present invention.

FIG. 4 shows the liner system of FIG. 2 being lowered into a cased borehole 42 in accordance with the presently disclosed apparatus and method. It is observed that the liner 21 is lowered, without everting, directly down the borehole; the liner is "right-side-out" and its interior initially is unpressurized, so that the non-dilated liner can be pulled down the borehole by the weight force of the weight 28. If the borehole is cased with a relatively slippery casing 42 (e.g., common PVC casing), the liner 21 can be safely lowered from the liner shipping reel 413 (at the ground's surface) into the casing. Access to the subsurface geologic formation 1 for extracting a water sample (or other measurement of the formation fluid) is provided if the borehole casing has one or more screened intervals 44 through which water samples can be drawn. Casing screened intervals 44 and 114 are typically surrounded by associated annular filter packs of sand, packs 45 and 412, with an annular sealing backfill material 48 between the sand-filled annuli 45 and 412 and disposed vertically between the screened intervals and the borehole wall 47. The liner system may contain a variety of measurement/sampling instruments and subassemblies as known in the art. As the liner 21 descends, its vertical elevation is regulated so that the spacers (e.g., spacers 24 and 217 of FIG. 2) register vertically with the screened intervals 44 and 411.

Further Disclosure Respecting the System of FIGS. 2 and 3

After the liner 21 has been lowered into place in the borehole 10, water is added (from the surface) to the central tube 25 to inflate the liner radially outward against the inside wall of the casing 42 to seal of the casing, thereby to isolate the one or more screened intervals 44 and 411 from connecting (and potentially cross-contaminating) flow inside the casing. The backfill material 48 between the casing 42 and the borehole wall (i.e., wall 10 in FIG. 1) is usually impermeable to prevent fluid communication between the screens in the annulus. If the liner 21 contains the normal water sampling tubing of FIG. 2, water samples can be drawn from the formation 1 via the screened interval(s).

An advantage of the flexible liner 21 being lowered into place in the manner illustrated in FIG. 4 is that any tubing (e.g., sampling tubing) incorporated or associated in the liner assembly can be emplaced down the borehole without the need for the tubing to evert with the liner 21. As mentioned, many sample tubes simply cannot evert with a liner, or if they do they kink or rupture. According to the present method, sample or pumping tubing can be of a larger diameter (and thus too stiff) than tubing suitably employed in everting liner systems and techniques. However, unlike previously attempted straddle packer methods which use rigid piping to deploy the liner down-hole, the entire system of the present disclosure can be shipped on a compact reel 412 and installed without a crane or other heavy equipment.

Attention is returned to FIG. 3. There is provided an especially compact spacer (such as spacer 217 in FIG. 2) which is attached to the exterior of the liner 21 and connected to the interior slender tubing 22. The spacer of FIG. 3 allows a continuous connection of the slender tubing 22 in the flexible liner 21 with the full length of the slotted screen (FIG. 4). The slotted screen is usually backed by a "sand pack" that allows connection of the screen with any permeable intervals in the formation. In some situations, the screen extends the full length of the borehole. In such a case, the spacer according to FIG. 3 allows a water sample to be drawn from only the screened interval subtended by the spacer. This is most useful if all the water samples are drawn from separate sampling tubes simultaneously. The special advantage of the simultaneous extraction is obtained if the pressure at each spacer is lowered by the same amount to develop a high pressure ridge separating the spacers for improved isolation of each extraction from its own approximate elevation.

A Useful Variation of the Above Design

Figure 5:
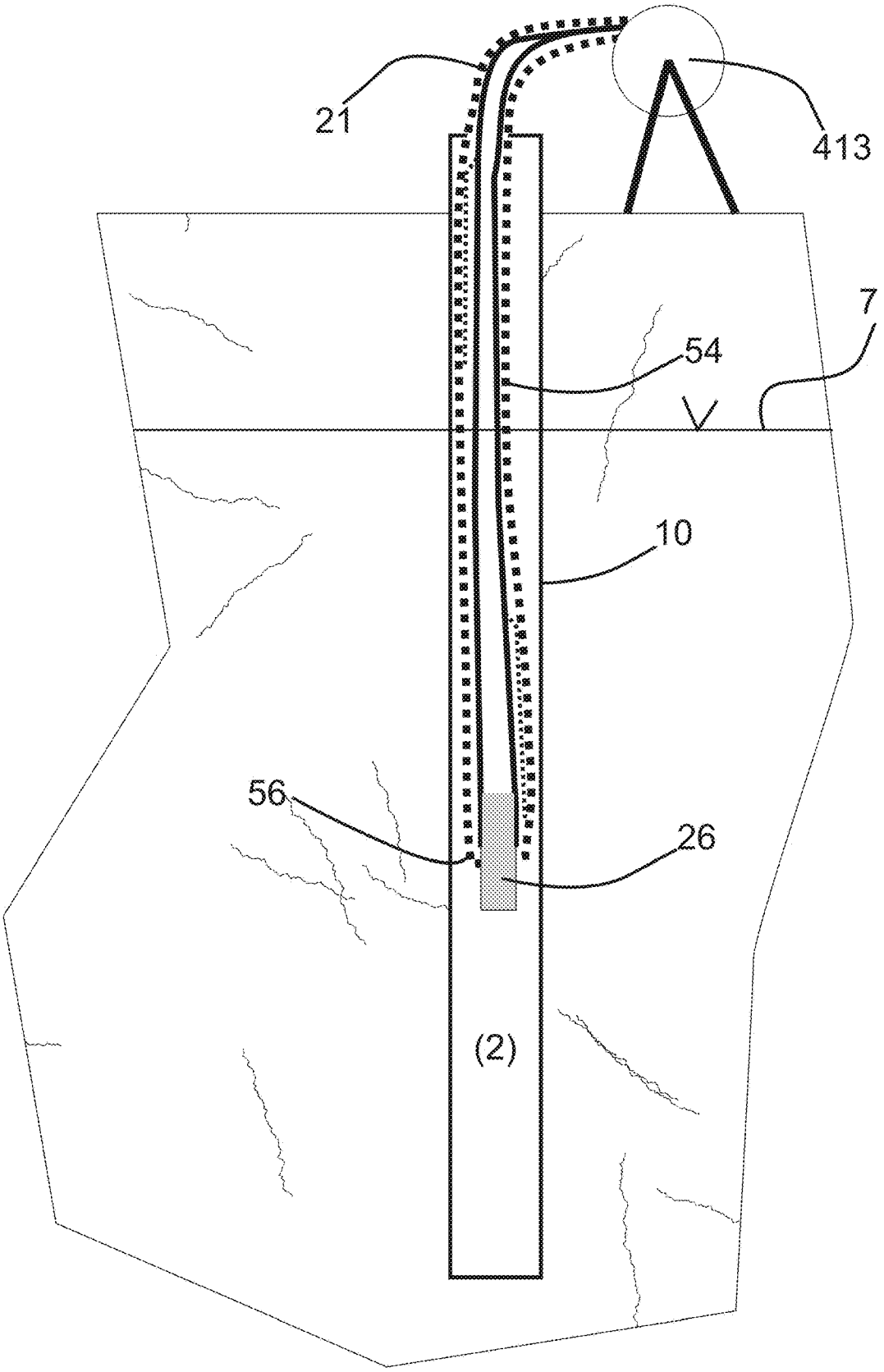
FIG. 5 is a side sectional view, similar to the view of FIG. 4, depicting the flexible abrasion protective sheath around the liner and according to the present invention.

The system of FIG. 4 is relatively safe from abrasion if lowered into a smooth PVC-cased hole. However, the same assembly of FIG. 4 can be lowered into an open uncased borehole if it is protected from abrasion against the normally abrasive wall (exposed geologic media) of an open borehole. Such a protective sheath 54 is shown in FIG. 5. In the practice of the invention, the liner 21 and sheath 54 are lowered simultaneously together into the borehole 2, after which the sheath is withdrawn from the borehole, leaving the liner in proper position in the borehole. The liner 21 is then inflated with a pressurizing fluid to seal the liner against the borehole wall 2. The sheath 54, composed of a durable but reasonably flexible material, is provided around the outside of the liner 21 at the time the liner is spooled upon its shipping reel 413. As the liner 21 is lowered down into the open (uncased) borehole 2 from the reel 413, the protective outer sheath 54 protects the liner from abrasion against the borehole wall 10. The sheath 54 is attached to the bottom end of the liner at connection 56, as described further herein with reference to FIG. 6. The protective tubular sheath 54 of FIG. 5 has special properties. The sheath 54 is very abrasion resistant and may be fabricated from, for example, a woven monofilament fabric. The sheath 54 preferably is water permeable (in contrast with the rigid pipe of the technique disclosed in U.S. Pat. No. 6,298,920). The permeability of the sheath 54 allows the pressure of ambient water within the borehole interior to collapse the liner 21, this reducing the drag of the liner 21 and sheath 54 against the borehole wall 10. Another advantageous feature of the sheath 54 is that it optionally may be somewhat smaller in diameter than the diameter of the borehole 2. Thus, it may mildly compress inward the liner 21 to allow the sheathed liner assembly to descend with minimal drag of the sheath 54 on the borehole wall 10—thus promoting the free descent of the liner 21 and sheath 54. The weight 28 (FIG. 2) attached to the bottom of the liner end seal 26 pulls on the liner 21 to encourage its descent down the borehole, despite drag between the sheath 54 and the borehole wall 10.

There is a potential hazard in that the drag of the protective sheath 54 on the hole wall 10 may be greater than the frictional drag between the outside of the liner 21 and the inside of the sheath 54. In such a circumstance, the liner 21 may descend, or slip downward, through the sheath 54, causing the sheath to buckle and crinkle around the outside of the liner, which prevents the liner and sheath from moving downward together to the bottom of the borehole 2. Such deleterious buckling of the protective sheath 54 exposes the liner 21 to abrasion to the extent the unprotected liner descends beneath the buckled sheath. To assure that the sheath 54 moves concurrently together with the liner 21, the sheath 54 preferably is attached to the sealed end 26 of the liner, at the bottom end of the liner, using an assembly seen in FIG. 6. Once the liner 21 is fully extended down into the borehole 2, the sheath 54 is removed by pulling it upward to the surface. The sheath 54 slips upward, as controllably pulled at the surface, between the liner 21 and the borehole wall 10, thereby leaving the liner fully extended in the borehole 2. But pulling the sheath 54 upward independently from the stationary installed liner 21 requires a release mechanism for the sheath where it is attached to the liner.

Figure 6A:
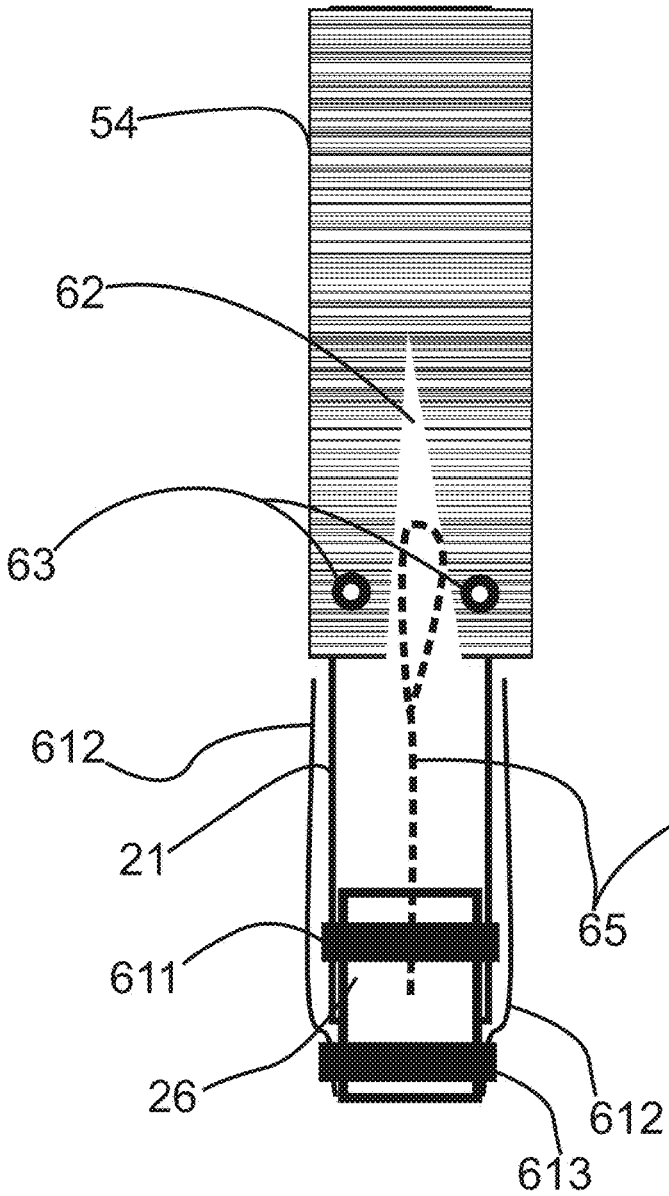
FIGS. 6A and 6B are side sectional views (mutually offset by ninety degrees) illustrating a releasable attachment means and method for the sheath, for preventing the sheath from buckling during liner system descent into an open borehole.
Figure 6B:
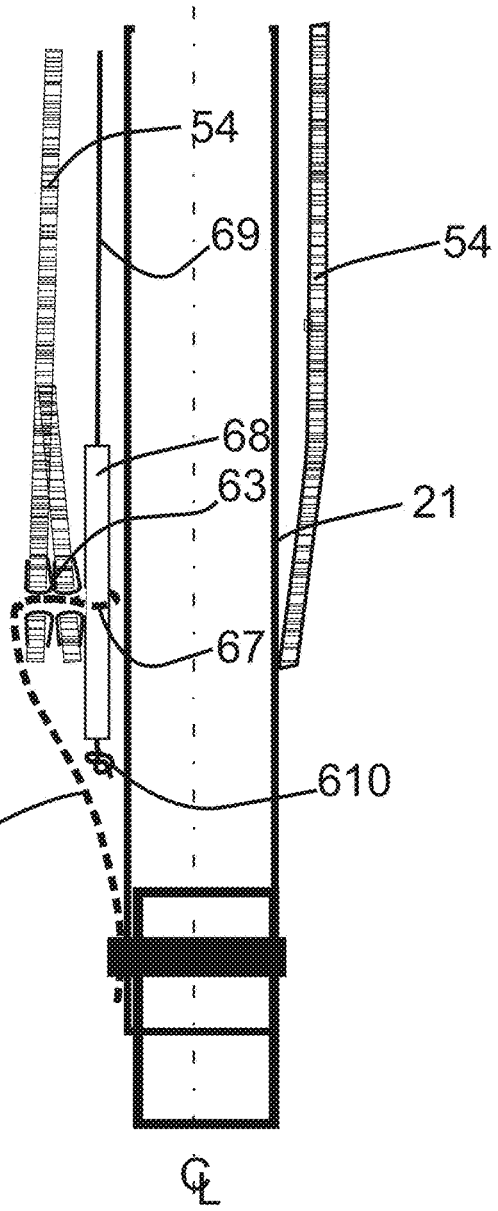

A suitable sheath release mechanism according to the present system and method is depicted in FIGS. 6A and 6B. Seen in these figures is the release mechanism situated near the respective bottom ends of the sheath 54 and liner 21. The release mechanism is initially configured prior to deploying the liner down the borehole, but must be reliably actuated after the liner 21 has reached the bottom of the borehole. In a preferred embodiment, the sheath 54 has a notch or slit 62 that extends vertically a short distance from the sheath's bottom end. A pair of grommets 63, 63' are emplaced in the sheath 54 laterally on opposite sides the slit 62, sufficiently far apart that when the bottom of sheath is manipulated close the slit and position one grommet 63 in registered alignment with the other grommet 63', the sheath 54 has a smaller effective diameter than the weighted bottom end of the liner 21. A small yet strong cord loop 65, having one end securely attached to the end seal 26, is threaded through the two aligned grommets as seen in the side sectional view of FIG. 6B. Thus, the first end of the cord 65 connects to the end seal 26, while the majority of the cord defines the loop best seen in FIG. 6A. The looped portion of the cord 65 is disposed through the grommets 63, 63', and emerges from the aligned grommets at location 67 in FIG. 6B. A flexible actuation tube 68 is pushed through the emergent loop 65 at location 67 (e.g., between the sheath 54 and the liner 21) to prevent the loop 65 being inadvertently pulled back through the overlapping grommets 63, 63'. The actuation tube 68 has a pull cord 69 threaded through the interior of the actuation tube, with a terminal knot or other enlargement 610 (FIG. 6B) at the distal end of the pull cord to secure the pull cord within in the actuation tube. The pull cord 69 has a high tensile strength, and preferably a low coefficient of friction so to slide readily between the sheath and the liner. The pull cord 69 extends upward to the surface, above the top end of the sheath 54. Thus, the cord loop 65 is disposed through the sheath aperture defined by the overlapping and aligned grommets 63, 63' and is looped at 67 around the actuation tube 68, while its other end is connected to the sealed end 26 of the liner 21. Thus initially configured, the release mechanism assures the sheath 54 cannot slide upward relative to the liner 21 during the descent in the borehole, because the looped cord 65 secured to the end seal 26 effectively but releasably interconnects the bottom ends of the sheath and liner, thus preventing the sheath from being able to shift upward relative to the liner.

The release mechanism is controllably actuatable from the surface in order to disconnect the bottom of the sheath 54 from the bottom of the liner 21. The connection between the sheath 54 and the liner 21, supplied by the looped engagement of the cord 65 through the grommets and around the actuation tube 68 at location 67, is releasable to permit the sheath to be removed from the borehole 2 while leaving the liner 21 in place. In order for the interconnection to be controllably released from the surface, the strong pull cord 69 passes through the interior of the sheath 54 to the surface. Deliberately sustained upward pulling, at the surface, on the proximate end of the cord 69 withdraws the actuation tube 68 from within the loop in the cord 65 at location 67. Disengagement of the actuation tube 68 from within the loop of the cord 65 frees the cord to slidably pass back through the grommets 63, 63', thereby releasing and relaxing the sheath 54 to dilate as the slit 62 reopens. The reopening of the slit 62 expands the effective diameter of the bottom end of the sheath 54, and frees the connection between the bottom end of the sheath and the bottom end of the liner 21. Operators at the surface then pull upward on the top end of the sheath 54, and the sheath 54 is then removed from around the outside of the liner 21 and is withdrawn to the surface. The weight 28 (FIG. 2) at the bottom end of the liner 21 helps prevent the liner 21 from rising with the sheath 54, so that the liner remains in place within the borehole. (This may particularly be the case for short liner installations with minimal drag of the liner 21 on the sheath 54.)

Figure 7:
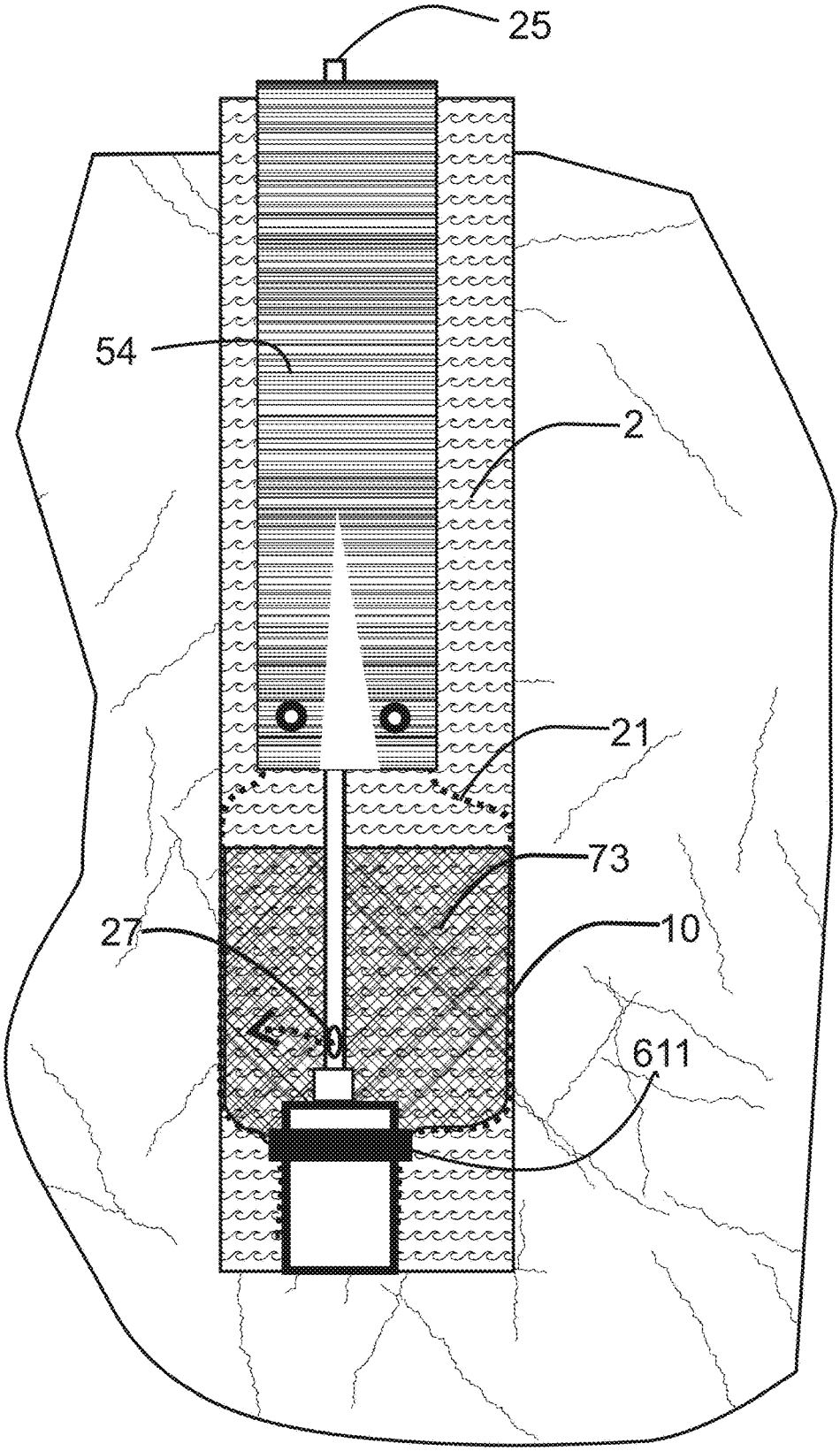
FIG. 7 is a side sectional view of a system and method according to the invention, depicting the optional addition of a heavy mud into the liner to anchor the liner prior to withdrawing the protective sheath from the borehole.

However, if the drag of the sheath 54 on the liner 21 is more than the combined weight of the weight 28 and the liner with its tubing while underwater in the borehole, the bottom end of the liner must be anchored in the borehole 2 in order that the liner not rise with the withdrawal of the sheath from the borehole. FIG. 7 illustrates a method for anchoring the liner 21 in the borehole 2. According to this method and system, a small volume of mud 73 is pumped to the closed bottom end of the liner 21 via the central tube 25 and through the port 27. The introduction of the heavy mud slug 73 causes the liner 21 to dilate against the borehole wall 10. The mud 73 supplies a sufficient lateral pressure which, combined with the large surface area of the liner 21 against the hole wall 10, prevents the liner 21 from inadvertently moving upward during sheath 54 removal. The average lateral pressure, Ph, of the mud 73 against the inside of the liner 21 (and therefore against the hole wall 10) is estimated as $Ph=(\rho-1)H\times0.433/2$ where $\rho$ is the density of the mud, H is the column height (depth) of the mud 73 in the liner. The Ph is in pounds per square inch if H is given in units of feet. The drag, D, on the hole wall resists the liner rising with the lifting of the sheath 54 from off the liner 21. D is equal to $Ph\times\pi r^2H\times f$ where r is the borehole radius and f is the friction coefficient of the liner 21 against the hole wall 10.

This precaution of mud addition is only needed for relatively deep installations, and when the liner weight is not sufficient to keep the liner 21 in place while the sheath 54 is lifted from the borehole. It is impressively beneficial that a modest mud pressure of the liner against the borehole wall produces a drag of the liner on the borehole wall exceeding a hundred pounds of drag resistance against sliding upward on the hole wall.

For the liner 21 at the wall 10 to be anchored by the friction of the liner 21 against the hole wall 10, a portion of the liner must be exposed beneath the sheath 54. However, such exposure may allow abrasion of the liner 21 during the installation descent in the borehole 2 (unless the liner 21 is otherwise protected). Referring still to FIG. 7, it is seen that such lowermost exposed portion of the liner 21, between the sheath 54 and an attachment clamp 611, can be protected by the separate short sheath 612 seen in FIG. 6A—separate from the main sheath 54, if the short sheath 612 has a diameter greater than the borehole. As shown by combined reference to FIGS. 6A and 7, the short sheath 612 is conveniently anchored by the same clamp 611 that secures the looped cord 65 to the end seal 26 on the bottom of the liner. The short sheath 612 of FIG. 6A has a length (vertically in the borehole) at least equal to the height of the mud-filled section of the liner 21. The mud fill 73, however, should not be allowed to rise into the sheathed interval secured with the grommets 63, 63', because such an excessively deep mud fill may deleteriously entrap the sheath 54 against the liner 21.

A Variation on the Anchor Design

Figure 8:
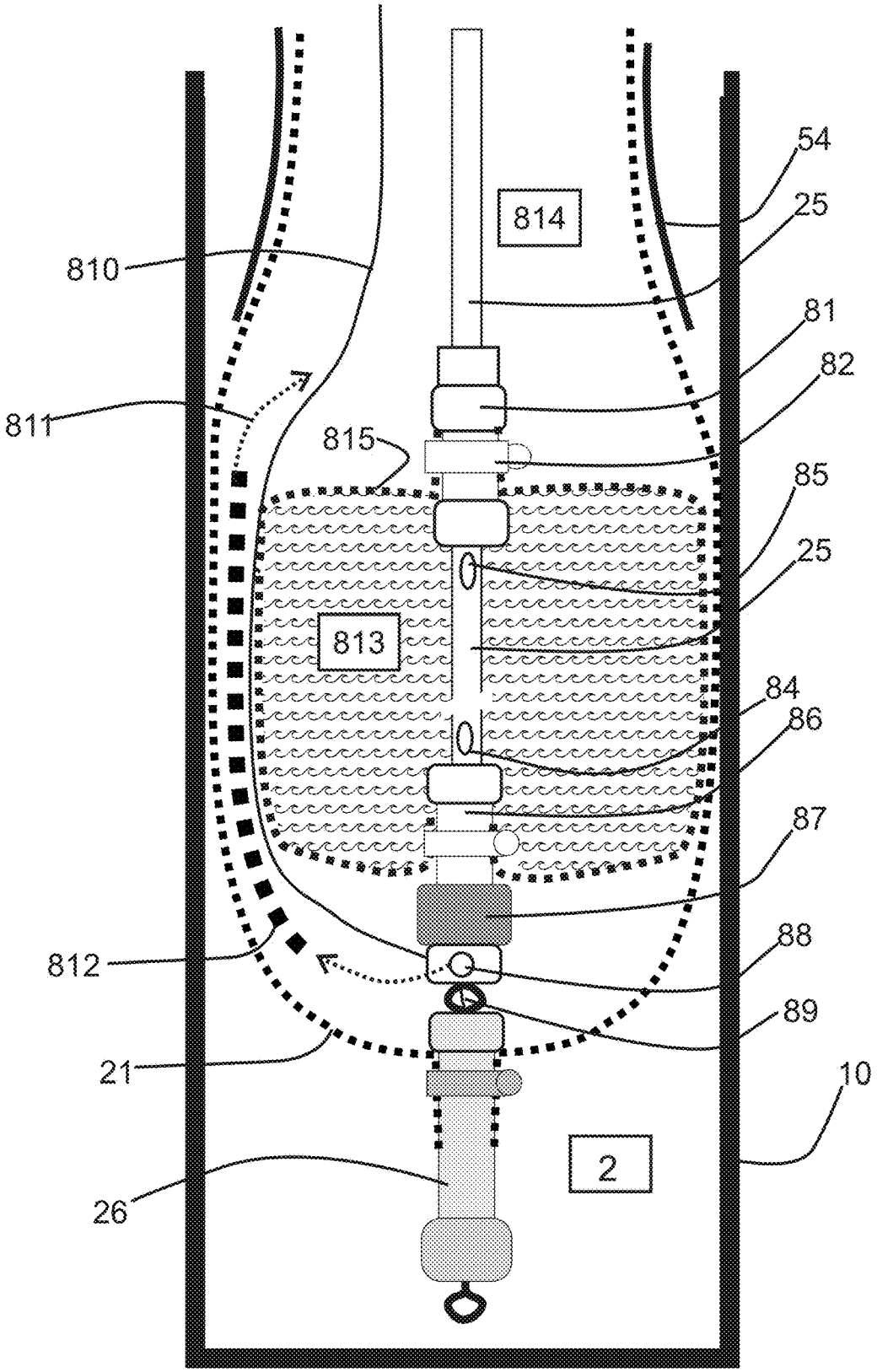
FIG. 8 is an enlarged side sectional view of an alternative liner anchor system and method according to the present invention, using an inflatable water balloon within the liner interior.

FIG. 8 shows an alternative system and method for anchoring the bottom end of the liner 21 against the borehole wall 10, to develop the needed resistance to the sheath's lifting of the liner when the sheath 54 is being lifted during extraction. This alternative mode may be called a "water balloon." The water balloon 815 is a segment of liner-like impermeable material attached around the bottom end of the central water addition tube 25 and sealed top and bottom. Adding water under modest pressure, e.g. just the overpressure of the water excess head in the tube 25, the short balloon 815 dilates against the liner 21. The pressure within the balloon 815 due to the interior water fill 813 forces the liner 21 against the hole wall 10, thereby producing a resistance to the liner's sliding up on the hole wall 10. That resistance drag, D, is simply the balloon water pressure P times the surface area of the balloon 815 in contact with the liner 21, multiplied by the friction coefficient, f, of the liner on the hole wall 10: $D=PAf$, where $A=\pi r^2L$ and where r is the borehole radius and L is the balloon length against the liner 21. The resulting drag, D, can be very large, and resists the undesired tendency of the sheath 54 drag during removal to lift the liner 21 up with the sheath.

The top of the balloon 815 is sealably attached to the cylindrical upper fitting 81 by means of an upper clamp 82. The bottom portion of the balloon 815 is similarly attached to a lower fitting 86. The tube 25 fills the balloon interior with water 813 that flows through the supply port 84 in the tube 25. Because, at the outset of system installation, the balloon 815 initially is collapsed by the ambient water pressure in the borehole 2, very little air is trapped in the balloon interior. A spring-loaded relief valve 87 is provided, and is biased closed during the water 813 addition to the interior of the balloon 815.

Other preferred features of the water balloon design are depicted by FIG. 8. Because the central tube 25 is normally used to inflate the liner 21 in the borehole 2 after the sheath 54 is withdrawn, such inflation function must be available after the sheath is extracted from around the liner. Therefore, at the bottom end of the balloon 815, a pressure relief valve 87 is sealably secured to the lower fitting 86. The fitting 86 is also clamped to and around the bottom of the balloon 815 to seal closed the balloon. The central tube 25 also passes, and is sealed, through the upper fitting 81. The top of the balloon 815 is sealably secured to the upper fitting 81 by means of the upper clamp 82. A first vent hole 84 is defined in the central tube 25 above the relief valve 87, and a second vent hole 85 is defined in the tube 25 near the top of the balloon 815 but beneath the upper fitting 81. Once the balloon is inflated with water 813, further increasing the water pressure in the tube 25 causes the relief valve 87 to open, thus allowing water to flow into the interior of the liner 21 below the balloon 815. The relief valve 87 is set to open at, for example, approximately 5 psi. A bypass tube 812 is provided vertically between the liner 21 and the balloon 815. The bypass tube 812 allows the water flow through and from the relief valve 87 to flow into a liner interior volume 811 above the balloon 815, and upward toward the surface, to dilate the upper extent of the liner to seal the borehole 2 even when the balloon 815 is inflated. The water addition through the tube 25 at higher pressure continues until the liner 21 interior is filled to a level well above the water table 219.

An optional feature of the embodiment of FIG. 8 is the strong cord 810, which extends from the top of the borehole and is secured to an eyebolt 89 connected to the end seal 26. The strong cord 810 may be used to support the weight 28 normally attached beneath the liner's end seal 26 (as seen in FIG. 2). The strong cord 810 is preferred for systems using heavy weights 28, in order to not support the weight 28 solely with the central tube 25 and fittings 81, 86 of the water balloon 815 (or with the tubing incorporated in the water sampling system of FIG. 2). The strong cord 810 is supported (not shown) at the wellhead at the surface in conjunction with support of the tubing included in the design.

Removal of the Liner

The removal of the liner 21 after use, a desirable aspect of the system and method, is achieved by injecting air into the central tube 25 at a pressure greater than the pressure at submerged depth of the bottom of the water balloon 815. The injected air passes out the upper vent hole 85 and expels the water 813 from within the balloon 815 via the lower vent hole 84. The water expelled through the lower vent hole 84 passes through the opened relief valve 87 and into the lower liner interior, to mix with the lower-pressure water inside the liner 21. Then, by controllably lowering the air pressure in the central tube 25 to atmospheric, the relief valve 87 closes, and the balloon 815 collapses under the higher water pressure within the liner 21. The balloon 815 thereafter no longer functions to anchor the liner 21 in the borehole 2. Pumping the water from within the liner 21 (and to the surface) using a pump (not shown) lowered into the liner interior causes the water pressure in the borehole 2 and outside the liner to collapse the liner. The liner 21 can then readily be lifted up and out from the borehole 2. If the natural water table is not more than 25 feet below the ground's surface, the water 813 in the balloon 815 can be removed from within the balloon by simply attaching a to the central tube 25 a peristaltic pump (not shown) at the surface.

Without the water balloon anchor 815 in use, the water within in the liner 21, as seen in FIG. 2, can be removed either through the central tube 25 or by using a pump lowered into the liner to collapse the liner for removal. When the mud anchor of FIG. 7 is used, at the conclusion of operations the mud 73 can be diluted with water added through the central tube 25, and the diluted mud can then be pumped from within the liner 21. After the water inside the liner 21 is removed, the liner collapses and can be lifted from the borehole 2 or the casing 42.

Another Application of the Sheathed Design

An attractive borehole liner function is to enable the extraction of contaminated water, or injection of remediation fluids, from/in discrete intervals of a borehole in a geologic formation. However, these functions require that the borehole be sealed except for the discrete borehole intervals of interest. Such extractions or injections require larger-diameter tubing than are normally incorporated in everting liner designs. But such large and stiff tubing advantageously can be included in liners that are lowered directly (and not be eversion) into the borehole or casing as described previously. An embodiment of the present invention shown in FIG. 9 thus has a borehole 2 in the formation 1 with a sealing liner 21. The liner 21 contains large-diameter tubing 910 which passes through the liner via a feed-through 23 to contact with a permeable geologic layer 93 outside of the liner 21. The tube 910 joins a second similar or even larger-diameter tube 96 at juncture 95 near the bottom of the liner 21. The second larger tube 96 extends to the surface at location 97. A second large-diameter tube 911 may extend through a similar liner feed-through 23 at a lower elevation in the borehole, for fluid communication with another, different geologic layer 98. Both tubes 910, 911 where they are exterior to the liner 21 typically are perforated and covered with a coarse mesh to assure a good hydraulic communication with the adjacent geologic formation's conductive features. The liner 21 is filled with water to seal the liner 21 against the borehole wall 10.

The natural tubing curvature when removed from a shipping reel can contribute to the abrasion of a liner 21 which is simply lowered down an open borehole 2. The use of the protective sheath 54 described above allows the installation of this system without abrasion of the liner 21, even when the sampling tubes tend to curve, so the sheath 54 allows the entire liner system to be conveniently shipped on a reel.

Figure 9:
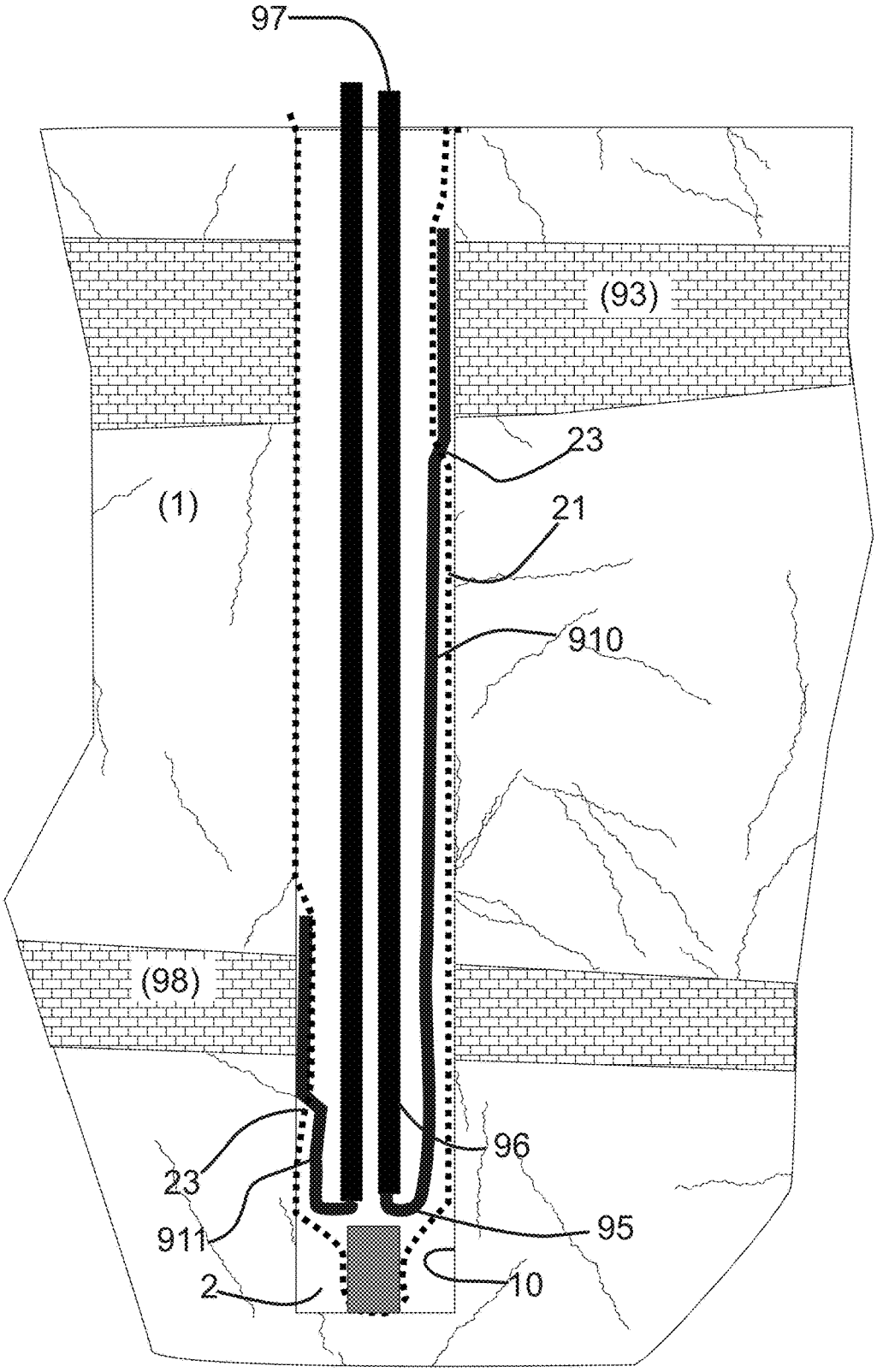
FIG. 9 is a side sectional view of a liner system and method according to the invention, requiring the abrasion protection of the sheath due to the use of stiff large-diameter tubing for borehole extraction/injection functions.
Figure 10:
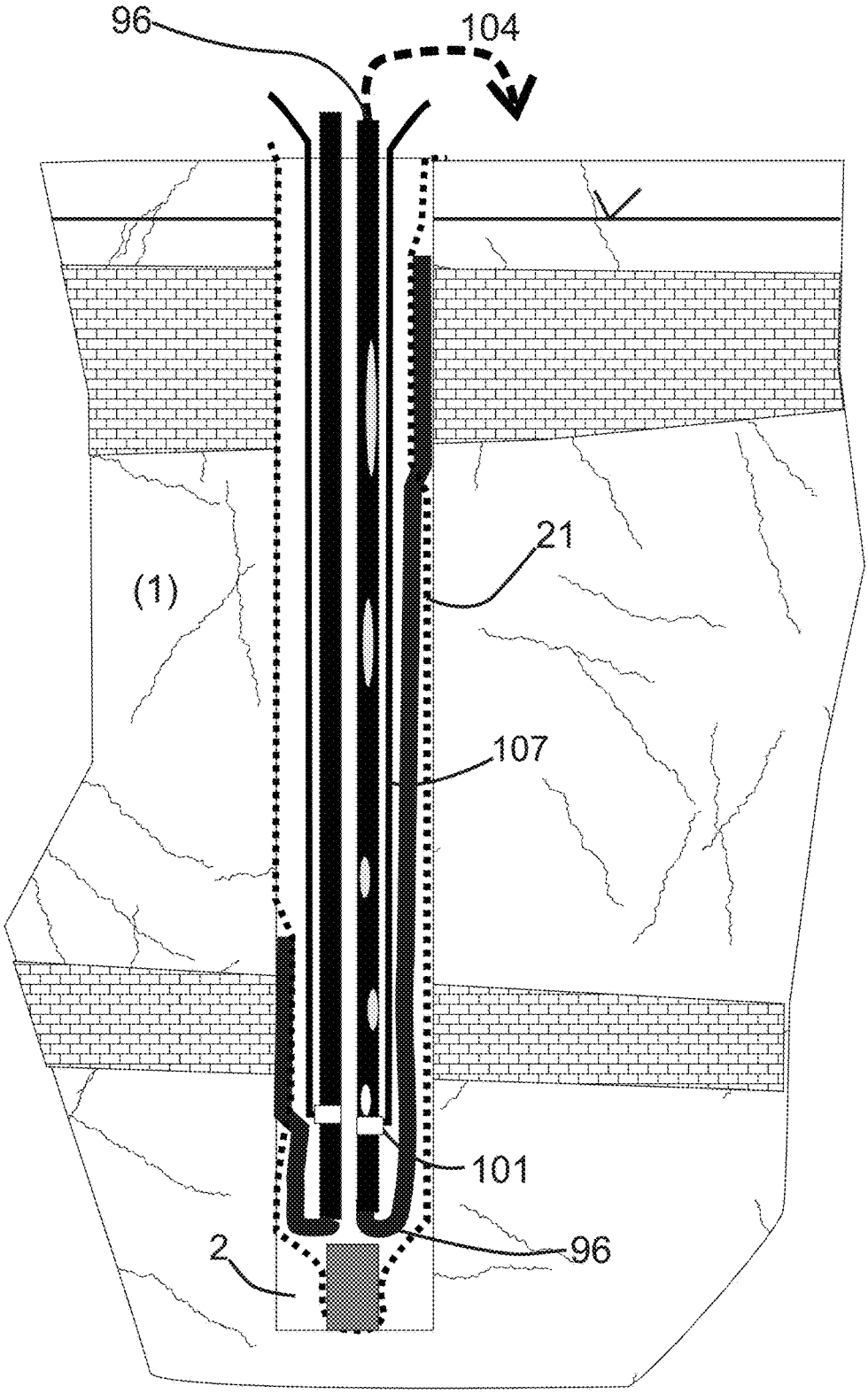
FIG. 10 is a side sectional view of a system and method of the present invention, depicting the ability to air lift pump a large diameter tubing installable according to the method of the present disclosure.

A further optional aspect of the embodiment of FIG. 9 is shown in FIG. 10. FIG. 10 illustrates the use of the larger-diameter tubing 96, as available with the sheathed liner configuration, to apply an air lift pumping mechanism to the larger-diameter tubing 96 contained within the interior of the liner 21. A small tube 107, for a regulated air injection, is connected to the larger-diameter tubing 96 at fitting 101 and runs upward from the fitting to the surface. Controlled air injection into the inside of the bottom of the larger-diameter tubing 96, via the small tube 107 and fitting 101, reduces the density of the water within the larger-diameter tube. This bubbling effect displaces to the surface 104 water within the tube 96, by the higher pressure of the normal density water in the surrounding formation 1. This is a known air lift pumping technique, but is possible with a flexible borehole liner only by the practice of the present invention, which enables the installation of larger-diameter tubing 96. The continuous flexible liner 21 can contain multiple such air lift pumping systems for extraction of water at high flow rates from the formation 1 at different discrete elevations. Again, installation and anchoring of the liner 21 according to the present foreclosure permits the use of larger-diameter tubing, which tubing cannot be used with everted liners. The simplicity of the air lift pumping system provided by the present system and method is attractive for pumping inside a sealed hole with no moving parts in the liner.

The liner system of U.S. Pat. No. 7,896,578 can be similarly sheathed and lowered into position in a cased or uncased hole. After the sheath is removed, the liner can be dilated to press the adsorptive carbon felt against the hole wall. The liner can then be removed after removing the water from the liner, or the liner can be inverted from the borehole or casing. The sheath can be only slightly permeable to gain the advantages described and also protect the liner with carbon felt from the contaminated borehole water exposure.

A flexible liner configured with relatively stiff tubing accordingly can be lowered into a smooth casing. However, the more general installation of a flexible liner into an uncased hole requires the protection of an abrasion-resistant sheath to prevent perforation of the thin liner material. The protective sheath also provides the advantage of the temporary compression of the liner's effective diameter to less than the borehole diameter, thereby to minimize the drag of the liner on the borehole wall—facilitating the descent of the liner into the borehole. Suitable sheathing fabric of the necessary properties of abrasion resistance, strength, low friction coefficient and permeability is commercially available at reasonable cost. The ability to lower a flexible liner into an open borehole without abrasion damage further allows the incorporation of large diameter tubes in a flexible liner. The thin, strong, flexible liner provides a superior seal of the borehole when emplaced in the described circumstances. The thin liner also allows the very compact assembly for this function in holes so small as 2 inches in diameter, and potentially smaller, without the bulk of tubing.

An additional advantage is the convenience of deployment of the entire system from a shipping reel in 10-15 minutes, without the need to use a pipe of many sections to provide similar protection. The use of rigid pipe to install a non-everted liner results in much higher cost, as a heavy crane truck and trained operators are necessary to remove the pipe sections. In beneficial contrast, the protective sheath according to the disclosed system and method is easily and quickly removed by one person onto a nearby reel.

Although the invention has been described in detail with reference to these preferred embodiments, other embodiments can achieve the same results. The present apparatus can be practiced by employing generally conventional materials and equipment. Accordingly, the details of such materials and equipment are not set forth herein in detail. In this description, specific details are set forth, such as specific materials, structures, processes, etc., to provide a thorough understanding of the present invention. However, as one having ordinary skill in the art would recognize, the present invention can be practiced without resorting strictly only to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents. The disclosures of all patents identified hereinabove are incorporated herein by reference.

What is claimed is:

1. A method for installing a flexible liner in a borehole and from the ground's surface, comprising:

surrounding an exterior surface of the liner with a protective sheath;

disposing a weight at a bottom end of the liner;

providing a central tube in an interior of the liner;

lowering together the liner and the sheath into the borehole by permitting the weight to pull the liner downward without everting the liner, situating the sheath between a borehole wall and the exterior surface of the liner;

protecting with the sheath the exterior surface of the liner from abrasive contact with the borehole wall;

withdrawing the sheath from within the borehole;

at least partially filling the liner interior with water from the surface via the central tube, thereby dilating the liner to press its exterior surface toward the borehole wall;

removing water from the liner interior, thereby collapsing inwardly the flexible liner; and lifting the liner from the borehole.

2. The method according to claim 1, further comprising:

releasably connecting the bottom end of the liner to a bottom end of the sheath, temporarily preventing the liner from moving vertically in the borehole independently from vertical movement of the sheath while lowering together the liner and the sheath into the borehole; and after lowering together the liner and the sheath into the borehole, releasing the connection of the bottom end of the liner to the bottom end of the sheath, permitting a withdrawal of the sheath from the borehole without also dragging the liner upward in the borehole.

3. The method according to claim 2, further comprising temporarily anchoring the bottom of the liner at or near a bottom of the borehole, before withdrawing the sheath from within the borehole.

4. The method of claim 3, wherein temporarily anchoring the bottom of the liner comprises:

introducing a volume of mud to a bottom segment of the liner via the central tube; and dilating, with the volume of mud, the bottom segment of the liner against the borehole wall, thereby supplying a lateral pressure of the bottom segment against the borehole wall, preventing the liner from moving upward in the borehole during withdrawal of the sheath.

5. The method of claim 4, further comprising, prior to lifting the liner from the borehole, the steps of:

diluting the volume of mud with water added through the central tube;

pumping the diluted mud from within the liner; and removing the water from inside the liner.

6. The method of claim 3, wherein temporarily anchoring the bottom of the liner comprises:

situating an expandable balloon within a bottom segment of the liner and sealably attached around a bottom end of the central tube;

adding water, via the central tube, to the interior of the balloon thereby dilating the balloon against the liner; and forcing the liner against the borehole wall, producing a resistance liner movement upward in the borehole.

7. The method according to claim 6, further comprising:

injecting air into the central tube at a pressure greater than a pressure at a submerged depth of a bottom of the balloon;

passing air out an upper vent hole in the central tube, expelling water from within the balloon via a lower vent hole in the central tube;

passing the water expelled via the lower vent hole through an opened relief valve and into a lower liner interior;

controllably lowering to atmospheric an air pressure in the central tube, closing the relief valve; and collapsing the balloon with the water pressure within the liner.

8. The method of claim 7 wherein lifting the liner from the borehole comprises inverting the liner.

9. The method according to claim 2, further comprising providing at least one another tube on or in the liner for extracting or injecting fluid into or from the borehole.

10. The method according to claim 9 wherein providing the at least one another tube comprises providing a larger-diameter tube with an outside diameter of at least 0.375 inches.

11. The method according to claim 10, further providing means, on the liner and in communication with the larger-diameter tube, for evaluating conditions in the borehole.

12. The method according to claim 11, wherein providing means for evaluating comprises selecting a member from the group consisting of spacers, chemically absorptive elements, reactive elements, fiber optics, and electronic sensors.

13. The method according to claim 9, further comprising providing a feed-through through the liner for conducting the at least one another tube from the liner interior to outside the liner.

14. The method according to claim 10, further comprising:

pumping air from the surface via an air tube to a juncture in the larger-diameter tube; and lifting to the surface, with the pumped air, water within the larger-diameter tube.

15. The method of claim 1 wherein lifting the liner from the borehole comprises inverting the liner.

16. A method for installing a flexible liner in a borehole and from the ground's surface, comprising:

surrounding an exterior surface of the liner with a protective sheath;

disposing a weight at a bottom end of the liner;

providing a central tube in an interior of the liner;

lowering together the liner and the sheath into the borehole by permitting the weight to pull the liner downward without everting the liner, situating the sheath between a borehole wall and the exterior surface of the liner;

protecting with the sheath the exterior surface of the liner from abrasive contact with the borehole wall;

withdrawing the sheath from within the borehole; and at least partially filling the liner interior with water from the surface via the central tube, thereby dilating the liner to press its exterior surface toward the borehole wall;

releasably connecting the bottom end of the liner to a bottom end of the sheath, temporarily preventing the liner from moving vertically in the borehole independently from vertical movement of the sheath while lowering together the liner and the sheath into the borehole;

providing at least one another tube on or in the liner for extracting or injecting fluid into or from the borehole;

after lowering together the liner and the sheath into the borehole, releasing the connection of the bottom end of the liner to the bottom end of the sheath, permitting a withdrawal of the sheath from the borehole without also dragging the liner upward in the borehole; and providing a feed-through through the liner for conducting the at least one another tube from the liner interior to outside the liner.

17. The method according to claim 16 wherein providing the at least one another tube comprises providing a larger-diameter tube with an outside diameter of at least 0.375 inches.

18. The method according to claim 17, further comprising:

pumping air from the surface via an air tube to a juncture in the larger-diameter tube; and lifting to the surface, with the pumped air, water within the larger-diameter tube.

19. The method according to claim 17, further comprising providing means, on the liner and in communication with the larger-diameter tube, for evaluating conditions in the borehole.

20. The method according to claim 19, wherein providing means for evaluating comprises selecting a member from the group consisting of spacers, chemically absorptive elements, reactive elements, fiber optics, and electronic sensors.

* * * * *